US005578901A

United States Patent [19]

Blanchet-Fincher et al.

[11] Patent Number: 5,578,901

[45] Date of Patent: Nov. 26, 1996

[54] DIAMOND FIBER FIELD EMITTERS

[75] Inventors: Graciela B. Blanchet-Fincher, Wilmington, Del.; Don M. Coates, Santa Fe; David J. Devlin, Los Alamos, both of N.M.; David F. Eaton, Wilmington, Del.; Aris K. Silzars, Landenburg, Pa.; Steven M. Valone, Santa Fe, N.M.

[73] Assignees: E. I. Du Pont de Nemours and Company, Wilmington, Del.; The Regents of the University of California, Oakland, Calif.

[21] Appl. No.: 387,539

[22] Filed: Feb. 13, 1995

Related U.S. Application Data

[63] Continuation-in-part of Ser. No. 196,340, Feb. 14, 1994, abandoned.

[51] Int. Cl.[6] ..... H01J 1/30; H01J 3/02

[52] U.S. Cl. ..... 313/496; 313/495; 313/309; 313/310; 313/336; 313/351

[58] Field of Search ..... 313/309, 336, 313/351, 495, 496, 310

[56] References Cited

U.S. PATENT DOCUMENTS

| | | | |
|---|---|---|---|
| 2,062,370 | 12/1936 | Miller | 250/27.5 |
| 3,866,077 | 2/1975 | Baker et al. | 313/336 |
| 3,883,760 | 5/1975 | Cunningham, Jr. | 313/55 |
| 4,143,292 | 3/1979 | Hosoki et al. | 313/336 |
| 4,728,851 | 3/1988 | Lambe | 313/309 |
| 4,859,493 | 8/1989 | Lemelson | 427/45.1 |
| 4,925,701 | 5/1990 | Jansen et al. | 427/38 |
| 4,960,643 | 10/1990 | Lemelson | 428/408 |
| 5,010,249 | 4/1991 | Nishikawa | 250/306 |
| 5,015,912 | 5/1991 | Spindt et al. | 313/495 |
| 5,055,744 | 10/1991 | Tsuruoka | 315/169.1 |
| 5,075,094 | 12/1991 | Morrish et al. | 423/446 |
| 5,080,975 | 1/1992 | Komaki et al. | 428/404 |

(List continued on next page.)

FOREIGN PATENT DOCUMENTS

| | | |
|---|---|---|
| 0377320 | 7/1990 | European Pat. Off. . |
| 0500119 | 8/1992 | European Pat. Off. . |
| 0588449 | 3/1994 | European Pat. Off. . |
| 0609532 | 8/1994 | European Pat. Off. . |
| 63-117993 | 5/1988 | Japan . |
| 4-157157 | 5/1992 | Japan . |
| WO94/15352 | 7/1994 | WIPO . |
| WO94/15350 | 7/1994 | WIPO . |
| WO94/28571 | 12/1994 | WIPO . |

OTHER PUBLICATIONS

Spindt, C. A. et al, "Physical Properties of Thin Film Field Emission Cathodes", *J. Appl. Phys.*, 47, 5248–5263 (1976).

Geis, M. W. et al, "Diamond Cold Cathode", *IEEE Electron Device Letters*, 12(8), 456–459 (1991).

Kumar, N. et al, *SID 93 Digest*, 1009–1011 (1993).

Wang, C. et al, *Electronics Letters*, 27(16), 1459–1461 (1991).

Davanloo, F. et al, *Journal Material Res.*, 5(11), 2398–2404 (1990).

Bachman, P. K. et al, *Diamond and Related Materials*, 1–12 (1991).

Angus, J. C. et al, *Proc. 2nd Intern'l Symp. on Diamond Materials*, The Electrochemical Society, Inc., Pennington, NJ, 91–8, 125–141 (1991).

Johnson, G. H., *Diamond and Diamond-Like Materials Synthesis*, MRS Symposia Proc. EA-15, 99 (1988).

Frenklach, M., *Proc. 2nd Intern'l Symp. on Diamond Materials*, The Electrochemical Society, Inc., Pennington, NJ, 91–8, 142 (1991).

(List continued on next page.)

*Primary Examiner*—Nimeshkumar Patel

[57] ABSTRACT

A field emission electron emitter comprising an electrode formed of at least one diamond, diamond-like carbon or glassy carbon composite fiber, said composite fiber having a non-diamond core and a diamond, diamond-like carbon or glassy carbon coating on said non-diamond core, and electronic devices employing such a field emission electron emitter.

58 Claims, 5 Drawing Sheets

U.S. PATENT DOCUMENTS

| | | | |
|---|---|---|---|
| 5,082,359 | 1/1992 | Kirkpatrick | 359/642 |
| 5,104,634 | 4/1992 | Calcote | 423/446 |
| 5,129,850 | 7/1992 | Kane et al. | 445/24 |
| 5,138,220 | 8/1992 | Kirkpatrick | 313/309 |
| 5,138,237 | 8/1992 | Kane et al. | 315/349 |
| 5,141,460 | 8/1992 | Jaskie et al. | 445/24 |
| 5,146,481 | 9/1992 | Garg et al. | 378/35 |
| 5,164,051 | 11/1992 | Komaki et al. | 204/129.43 |
| 5,180,951 | 1/1993 | Dworsky et al. | 315/169.3 |
| 5,199,918 | 4/1993 | Kumar | 445/50 |
| 5,229,099 | 7/1993 | Roy | 423/461 |
| 5,256,888 | 10/1993 | Kane | 257/77 |
| 5,258,685 | 11/1993 | Jaskie | 313/309 |
| 5,308,661 | 5/1994 | Feng et al. | 427/535 |
| 5,358,741 | 10/1994 | Gat | 427/249 |
| 5,374,414 | 12/1994 | Morrish et al. | 423/446 |

OTHER PUBLICATIONS

Maeda, H. et al, *Journal of Crystal Growth,* 121, 507–515 (1992).

Givargizov, E. I. et al, *Mat. Letters,* 18(1.2), 61–63 (1993).

Stojanovic et al, *Electronics Ltrs.,* 27(16), 1459–1461 (1991).

Dotter et al, "Nucleation & Growth of Highly Transparent Nanocrystalline Diamond Films in Diamond Materials", Dismukes, et al (Eds.), Electrochemical Soc., NJ, Inc., 746–752 (1993).

Ting et al, *Diamond and Related Materials,* 2, 1069–1077 (1993).

Roy et al, *Mat. Trd. Bull.,* 28, 861–866 (1993).

Bajic, S. et al, *J. Phys. D: Appl. Phys.,* 21, 200–204 (1988).

*CRC Handbook of Chemistry and Physics,* 7rd edition, CRC Press, 12–10 (1992).

Xu, N. S. et al, *Electronics Letters,* 29(18), 1596–1597 (1993).

Litz, M. S. et al, "Rep–rate Explosive Whisker Emission Cathode Investigations", *SPIE Proceedings,* vol. 2154, Jan. 1994, Los Angeles, CA.

Li, Z., "Orientation relationship between chemical vapor deposited diamond and graphite substrates," *J. Appl. Phys.,* 73(2), 711–715 (1993).

Roy, R. et al, "Crystallization of diamond below 1 atm from Carbon–Metal Mixtures", *J. Mater. Chem.,* 3(6), 685–686 (1993).

Solomons, T. W. G., "Chapter 2: Some Representative Carbon Compounds", *Organic Chemistry,* John Wiley & Sons, NY, 48–49 (1980).

DIAMOND FIBER FIELD EMITTERS

This application is a continuation-in-part of Ser. No. 08/196,340 filed Feb. 14, 1994, now abandoned.

FIELD OF THE INVENTION

The present invention relates to the technical area of the field emission of electrons and more particularly to diamond fiber field emitters and their use in electronic applications. This invention is the result of a contract with the Department of Energy (Contract No. W-7405-ENG-36).

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, and klystrons. Field emitters of etched silicon or silicon microtips have been known (see Spindt et al., "Physical Properties of Thin Film Emission Cathodes", J. Appl. Phys., vol. 47, pp. 5248, 1976), but require expensive and elaborate fabrication techniques. Additionally, such field emission cathodes suffer from relatively short lifetimes due to erosion of the emission surfaces from positive ion bombardment.

Others have deposited diamond coatings on silicon surfaces to use the intrinsic electronic properties of diamond, i.e., its negative or low electron affinity. Negative electron affinity means that conduction electrons can easily escape from a diamond surface into vacuum. For example, diamond has been deposited by chemical vapor deposition (CVD) upon silicon substrates for formation of field emitters (see Geis et al., "Diamond Cold Cathode", IEEE Electron Device Letters, vol. 12, no. 8, pp. 456–459, 1991. However, these attempts have yielded low current densities, estimated from about 0.1 to 1 amperes per square centimeter ($A/cm^2$), these current densities requiring a high voltage for initial electron emission and accordingly, high power consumption. Recently, amorphic diamond thin films have been deposited upon substrates such as chrome or silicon by laser ablation (see Kumar et al., SID 93 Digest, pp. 1009–1011, 1993) to form field emitters. These field emitters have achieved current densities exceeding those achieved by the earlier silicon microtips or etched silicon, and have achieved light emission from a phosphor bombarded by electrons from such a diamond coated field emitting surface. In one such coating of diamond by CVD upon a silicon or molybdenum substrate, it was found that graphite impurities or graphite particle-like inclusions present from the diamond deposition may have resulted in improved field emission (see Wang et at., Electronics Letters, vol. 27, no. 16, pp. 1459–1461 (1991)).

Further work involving diamond-coated field emitters has been performed by Jaskie and Kane (see U.S. Pat. Nos. 5,129,850; 5,138,237; 5,141,460; 5,256,888; and 5,258,685). They describe, e.g., forming field emission electron emitters by providing a selectively shaped conductive/semiconductive electrode having a major surface, implanting ions as nucleation sites onto at least a part of the major surface of the conductive/semiconductive electrode, and growing diamond crystallites at some of the nucleation sites, to produce an electron emitter including a coating of diamond disposed on at least a part of the major surface of the selectively shaped conductive/semiconductive electrode. These emitters are essentially a Spindt-type microtip or cathode overcoated with diamond film. Also, Dworsky et al. (U.S. Pat. No. 5,180,951) have described an electron emitter employing a polycrystalline diamond film upon a supporting substrate of, e.g., silicon, molybdenum, copper, tungsten, titanium and various carbides, with the surface of the diamond film including a plurality of 111 crystallographic planes of diamond or 100 crystallographic planes to provide a low or negative electron affinity. Dworsky et al. teach that the supporting substrate can be substantially planar thereby simplifying the fabrication of the electron emitter.

Despite the recent advances, further improvements in current densities and electron emission efficiency of field emitters are believed necessary to reduce power consumption requirements in most applications. Other improvements are needed in reproducibility of the emitters, in the lifetimes of the emitters and in reduced fabrication costs of the emitters.

In fabricating electronic devices, such as a flat panel display, field emitters have typically been formed as small flat plates, often referred to as cold cathodes. Several such small flat plates have then been pieced together in the fashion of tiles to provide the electron emission for a larger flat panel display. This leads to distinct lines or gaps in the emission pattern around the edges of the small flat plates or tiles. There are presently no techniques to fabricate a field emitter having greater than about a few square inches in surface area. Accordingly, the ability to readily and easily fabricate field emitters having a surface area of greater than a few square inches, e.g., a surface area the size of the ever larger display, e.g., television, screen sizes, is desirable.

Despite the level of industrial activity in the area of field emission of electrons, numerous problems and difficulties remain.

It is an object of the present invention to provide a field emitter material having high electron emission efficiency and low voltage requirements, i.e., low voltage switch-on requirements.

Another object of the present invention is to provide a field emitter material having a longer lifetime or longer period of operation in the face of positive ion erosion.

A further object of the present invention is to provide an easily fabricated field emitter.

Still another object of the present invention is to provide a field emitter material having ease of fabrication into large, e.g., up to a square foot and larger, emission surfaces.

A still further object of the present invention is to provide electronic devices employing the field emission emitter materials of this invention.

Yet another object of the present invention is to provide field emitter materials suitable for providing a variety of field emitter cathode geometries.

Other objects and advantages of the present invention will become apparent to those skilled in the art upon reference to the drawings and detailed description of the invention which hereinafter follow.

SUMMARY OF THE INVENTION

To achieve the foregoing and other objects, and in accordance with the purposes of the present invention, as embodied and broadly described herein, the present invention provides a field emission electron emitter including an electrode formed of at least one diamond, diamond-like carbon or glassy carbon composite fiber, said composite fiber comprising a non-diamond core and a diamond, diamond-like carbon or glassy carbon coating on said non-diamond core. The non-diamond core can be made of a conductive or semi-conductive material. The non-diamond core can also be made of a non-conductive material surrounded by a film coating of conductive or semi-conductive material.

The present invention further provides a field emission electron emitter for use in an electronic device, the emitter including a fibrous integral electrode having a surface area which can be greater than about one square foot, the fibrous electrode formed of at least one diamond, diamond-like carbon or glassy carbon composite fiber, said composite fiber comprising a non-diamond core and a diamond, diamond-like or glassy carbon coating on said non-diamond core.

The present invention further provides a display panel apparatus comprising a cathode formed of at least one diamond, diamond-like carbon or glassy carbon composite fiber, said composite fiber comprising a non-diamond core and a diamond, diamond-like or glassy carbon coating on said non-diamond core, an anode spaced apart from the fibrous cathode, the anode including a layer of a patterned optically transparent conductive film upon a cathode-facing surface of an anode support plate, and a layer of a phosphor capable of emitting light upon bombardment by electrons emitted by the composite fiber of the cathode, the phosphor layer situated adjacent the layer of patterned optically transparent conductive film, and a gate electrode situated between the anode and the cathode, the gate electrode including a patterned structure of conductive paths arranged substantially orthogonally to the patterned optically transparent conductive film, each conductive path selectively operably connected to an electron source, and a voltage source connected between the anode and fibrous cathode.

In all aspects of the invention, it will be understood that electron emission occurs along the length of the fiber.

As used herein, the term "display panel" embraces planar and curved surfaces as well as other possible geometries. In addition, it will be understood that the description of the composite fiber as having a diamond, diamond-like or glassy carbon coating, also includes a coating comprising combinations thereof.

DETAILED DESCRIPTION OF THE PREFERRED EMBODIMENTS

Figure 1:
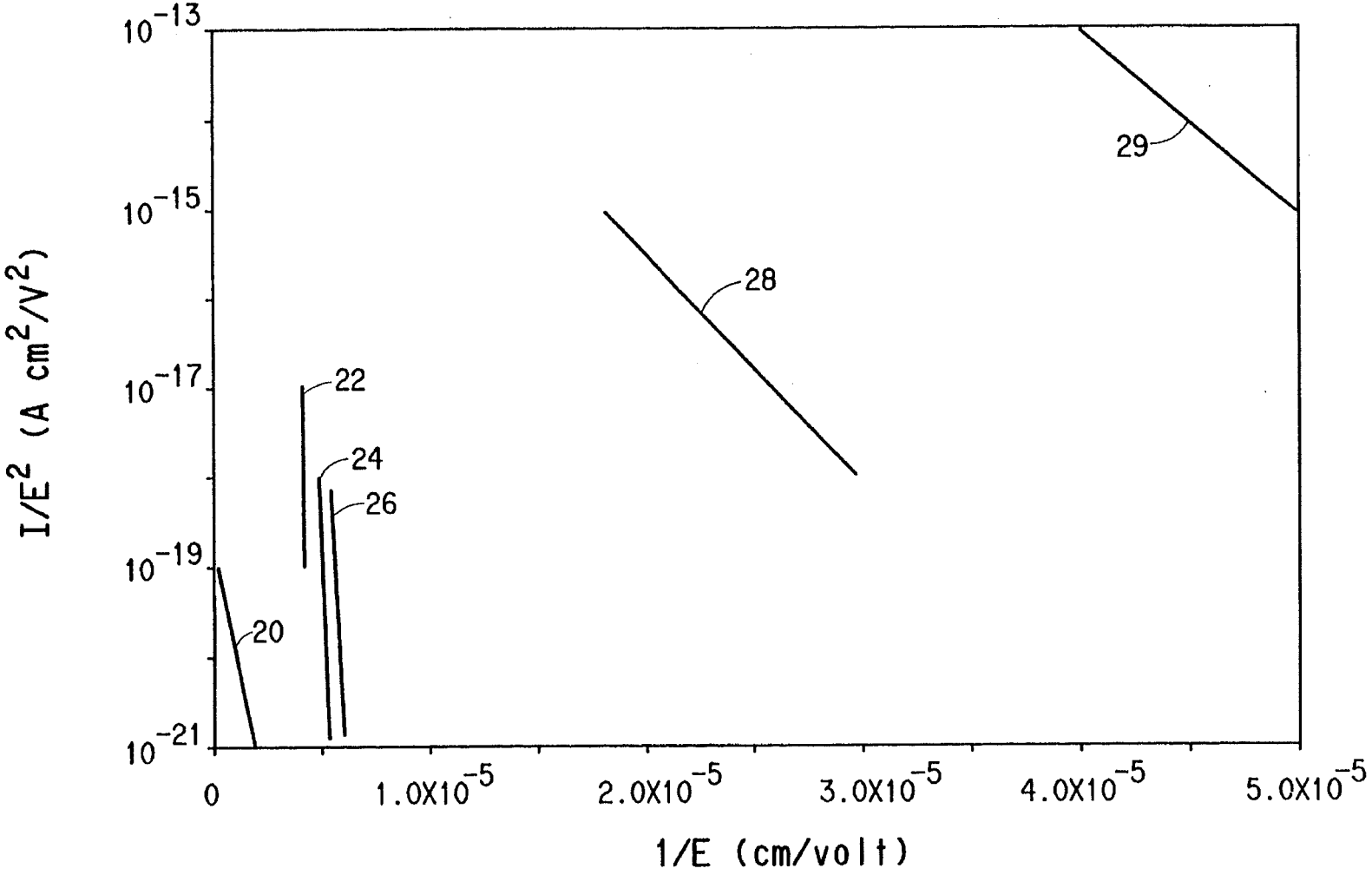
FIG. 1 shows comparative Fowler-Nordheim-like plots of field emission materials from the prior art and from the present invention.

The present invention is concerned with field emission materials also known as field emitters and field emission electron sources. In particular, the present invention concerns the use of diamond fiber field emission materials and the use of such emitters in electronic applications. The present invention may also employ diamond-like carbon or glassy carbon fibers as field emission materials.

Diamond fibers, e.g., fibrous diamond composites such as diamond coated-graphite or diamond-coated carbon, can provide for field emission materials with high current densities. Such diamond fibers preferably include a sub-micron scale crystal structure of diamond, i.e., diamond having crystal sizes of generally less than about 1 micron in at least one crystal dimension. Within the sub-micron sized diamond crystals, such diamond crystals include at least some exposed 111-oriented crystal facets, some exposed 100-oriented crystal facets, or some of both. Another form of diamond having suitable sub-micron dimensions is commonly referred to as cauliflower-diamond which has free grained balls as opposed to a pyramidal structure.

Fibers including diamond-like carbon with an appropriate short range order, i.e., a suitable combination of $sp^2$ and $sp^3$ bonding may also provide for field emission materials with high current densities. By "short range order" is generally meant an ordered arrangement of atoms less than about 10 nanometers (nm) in any dimension. It may also be possible to use fibers, e.g., carbon fibers, coated with amorphic diamond via laser ablation as described by Davanloo et al. in J. Mater. Res., Vol. 5, No. 11, November 1990.

Fibers containing glassy carbon, an amorphous material exhibiting two Raman peaks at about 1380 $cm^{-1}$ and 1598 $cm^{-1}$, are also useful as field emitter materials. "Glassy carbon" is used herein to designate the material referred to in the literature as glassy carbon and carbon containing microscopic inclusions of glassy carbon, all of which are useful as fiber emission materials.

Diamond fibers used as the field emission materials can generally be a composite of a non-diamond core with a thin layer of diamond surrounding the core. Preferably, the core material is conductive or semiconductive, however, the core may be made of a non-conductive material surrounded by a film coating of conductive or semi-conductive material. The core material in the diamond fiber can be, e.g., a conductive carbon such as graphite or a metal such as tungsten, or can be, e.g., silicon, copper, molybdenum, titanium or silicon carbide. In another embodiment, the core may consist of a more complex structure, for example, a non-conductive material surrounded by a thin coating of conductive or semiconductive material. A diamond, diamond-like or glassy carbon layer is then coated on the sheath. As examples, the non-conductive core can be a synthetic fiber such as nylon, Kevlar® (Kevlar® is a registered trademark of E. I. du Pont de Nemours and Company, Wilmington, Del.), or polyester or inorganic materials such as ceramics or glass. In other embodiments, a diamond, diamond-like carbon or glassy carbon precursor can be coated onto the non-diamond core or the core can be a diamond, diamond-like carbon or glassy carbon precursor and the diamond, diamond-like carbon or glassy carbon is then formed by appropriate treatment of the precursor.

Generally, the composite fibers have a total diameter of from about 1 micron to about 100 microns, preferably from about 3 microns to about 15 microns. The diamond layer or coating in such a composite fiber can generally be from about 10 Angstroms to about 50,000 Angstroms (5 microns), preferably from about 50 Angstroms to about 20,000 Angstroms, more preferably from about 50 Angstroms to about 5,000 Angstroms.

The diamond, diamond-like carbon or glassy carbon materials used in coating the non-diamond core of the fibers should have a low or negative electron affinity thereby allowing electrons to easily escape from the diamond, diamond-like carbon or glassy carbon surface. Diamond typically has various low index facets of low or negative electron affinity, e.g., 100-faceted diamond with a low affinity whereas 111-faceted diamond has a negative electron affinity. Diamond-like carbon or glassy carbon may preferably be n-type doped with, e.g., nitrogen or phosphorus, to provide more electrons and reduce the work function of the material.

Such a diamond, diamond-like carbon or glassy carbon layer preferably has rough jagged edges such that a series of spikes and valleys is present upon the diamond, diamond-like carbon or glassy carbon layer. In diamond coatings, this surface morphology results from a microcrystalline structure of the diamond material. It may be preferred that a minor amount of graphite be situated between at least a portion of said diamond crystals within said diamond coating for best results. It may also be preferred that diamond grown via CVD develop in columnar fashion due to slight misalignment between the growing crystals. This misalignment may also promote the development of the rough jagged edges of the diamond morphology.

While not wishing to be bound by the present explanation, it is believed that the performance of the diamond fibers in achieving the observed current densities is the result of a combination of factors including, e.g., greater nucleation density resulting from diamond nucleation properties of the fiber substrate, e.g., graphite or tungsten, the presence of minor amounts of graphite impurities or occlusions between diamond microcrystals, the possibility of registry between atoms of the fiber core, e.g., the graphite, and the diamond, i.e., atoms of diamond and graphite lining up to essentially an epitaxial-type position, and the geometry of the diamond composite fiber itself in comparison to a flat surface emitter, i.e., the small radius of curvature of a fiber increases the field effect.

In another embodiment of the present invention, diamond fiber may be used in conjunction with a conductive carbon substrate to form a field emitter. For example, diamond fiber prepared by plasma-assisted conversion of a solid hydrocarbon material such as a green oxygen-stabilized hydrocarbon material as described in co-pending patent application Ser. No. 08/133,726, filed on Oct. 7, 1993 by Valone et al. for "Plasma-Assisted Conversion of Solid Hydrocarbons to Diamond", such description incorporated herein by reference, may be combined with a graphite substrate to form a field emitter. Such diamond fiber may be formed in the shape of a diamond fibrous mat and the diamond mat laid up adjacent to the graphite substrate. Preferably, the diamond fibrous mat and the graphite substrate would be in electrical contact.

Various fiber or fiber-like geometries are possible in forming the field emitters. By "fiber" is meant one dimension substantially greater than the other two dimensions. By "fiber-like" is meant any structure resembling a fiber even though that structure may not be movable and able to support its own weight. For example, certain "fiber-like" structures, typically less than 10 μm in diameter, could be created directly on the substrate.

The fibers can have any shape fiber cross-section limited only by the design of the spinneret. Additionally, variations in the shape of the spinneret may lead to desirable internal molecular microstructure within the fibers themselves. The fibers can be arranged as a woven fabric spread out in a plane parallel to an anode or may be configured as otherwise desired for arrangement as the cathode into a particular field emission electron emitter assembly. For example, the cathode may be shaped for optimal performance in combination with any particularly shaped anode. Such shapes can include curved as well as flat. In another fashion, the fiber tips can be arranged perpendicular to the plane of the anode. The fiber may also be bundled together in the fashion of multiple filaments and may be woven like a thread or yarn either in a plane parallel to or perpendicular to the anode.

In another embodiment of the invention, the various fibers can be individually addressable, i.e., each fiber can be selectively activated such that in an electronic device the need for a secondary row of conductors, i.e., a gate-type electrode of a triode, may be eliminated. However, when the various fibers can be individually addressable, a gate-type electrode can be useful for controlling emission, beam steering and electron focusing.

One manner of providing diamond composite fibers is to coat a fiber-shaped substrate with diamond via a plasma CVD process with microwave excitation, RF excitation or hot filament excitation of a feed gas mixture including a minor amount of a carbon-containing gas such as methane, ethylene, carbon monoxide and the like and a major amount of hydrogen. The diamond CVD coating process is slightly modified when graphite is the core of the diamond composite core, since graphite is known to be a difficult material to coat with diamond via CVD due to premature etching away of the graphite substrate by atomic hydrogen in the plasma. Accordingly, graphite fibers are preferably pre-treated to increase the density of nucleation sites of the diamond upon the graphite fibers surface thereby increasing the rate of diamond deposition which can serve to protect the graphite from etching. The graphite fibers can be abraded with a material having a Mohs hardness harder than the graphite, e.g., diamond powder or grit, in a liquid medium, preferably an organic solvent medium such as methanol.

Figure 3:
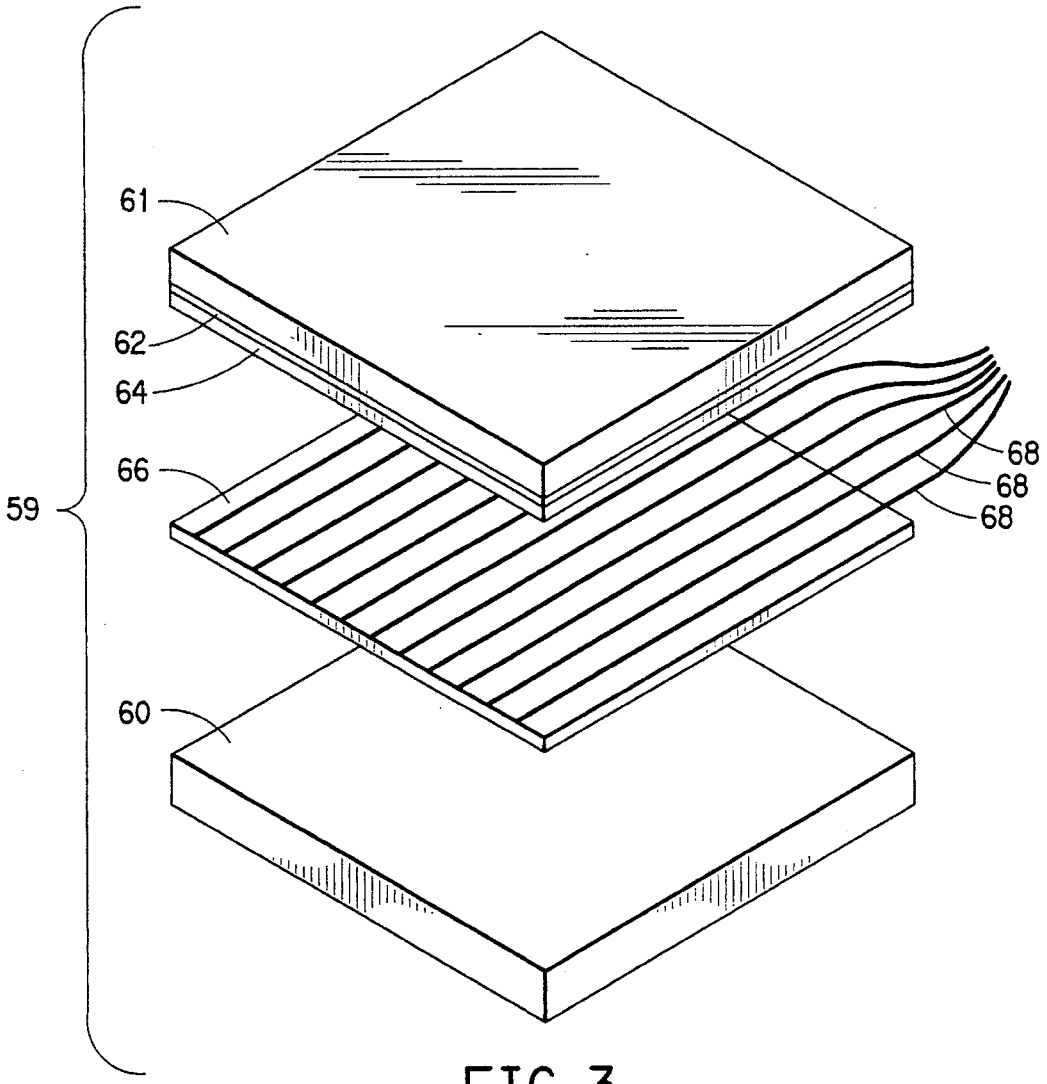
FIG. 3 is a schematic of a triode device employing the diamond fiber emission materials of the present invention.

Fabrication of an exemplary electronic device, i.e., a triode device and in particular, a field emission display device 59 as shown generally in schematic FIG. 3, can be as follows. The diamond-graphite composite structure serves as the electron emitting cathode 60 for the device. Spaced apart from this cathode is a glass anode plate 61 coated on the cathode-facing surface with a patterned layer of an optically transparent conductive coating 62 such as indium-tin oxide (ITO) and further having a layer of a phosphor 64 such as ZnO over the ITO layer. A gate electrode 66, which should be transparent to electrons, is located between the cathode and the anode. Gate electrode 66 includes a patterned structure of conductive paths 68 with each conductive path selectively operably connected to an electron source. The patterned structure of conductive paths 68 of gate electrode 66 and patterned optically transparent conductive coating 62 are arranged orthogonally, e.g., at right angles to one another. By such an assembly, the electron emission from the fibrous cathode can be selectively controlled to generate addressable control of pixels in the phosphor layer of the display panel. This assembly is placed into a vacuum chamber at about $10^{-7}$ Tort and light emission is obtained upon applying suitable voltage, e.g., 400–8,000 Volts (V), to the anode columns and to the selectively operably conductive paths of the gate electrode while maintaining the cathode at ground.

The display panel provided by this invention comprises (a) a fibrous cathode formed of diamond, diamond-like carbon or glassy carbon composite fibers consisting essentially of diamond, diamond-like carbon or glassy carbon on non-diamond core fibers, (b) a patterned optically transparent electrically conductive film serving as an anode and spaced apart from the fibrous cathode, (c) a phosphor layer capable of emitting light upon bombardment by electrons emitted by the composite fibers and positioned adjacent to the anode, and (d) one or more gate electrodes disposed between the phosphor layer and the fibrous cathode. It will be understood that the arrangement of the anode and the phosphor layer may vary without departing from the spirit of the invention. In other words, the phosphor layer may be positioned between the anode and the cathode or, alternately, the anode may be positioned between the phosphor layer and the cathode.

The non-diamond core fibers of the fibrous cathode are preferably electrically conductive or semiconductive. Typically, the core fibers are graphite, metals such as tungsten, molybdenum and chromium, or silicon. In an alternate embodiment, the core can be a metallized insulator such as tungsten or nickel coated on a non-conductive polyester, nylon or Kevlar® fiber or inorganic materials such as ceramics or glasses. For convenience of manufacture the fibrous cathode can be supported on a substrate which can itself be conductive or nonconductive. Alternatively, the fibrous cathode can be suspended on stand-offs or pedestals.

The anode is a patterned optically transparent electrically conductive film on an anode support plate. Typically, the anode support plate will be an optically transparent material such as glass and the electrically conductive film will be indium-tin oxide. The patterned conductive film is on the side of the anode support plate facing the cathode. In a preferred embodiment, the patterned conductive film consists of rows of conductive material. The cathode and anode are planar structures although the surfaces may be configured to optimize performance of the field emitter. The plane of the anode is essentially parallel to the plane of the cathode. The cathode and anode are spaced apart from one another by a mechanical spacer made from a material which is an electrical insulator. The phosphor is one which emits light of desired wavelength upon bombardment by electrons emitted by the diamond, diamond-like carbon or glassy carbon composite fibers. Examples of such phosphors are ZnO, ZnS, doped ZnS, $Y_2O_2S$ and the like. Preferably the phosphor layer is immediately adjacent to the anode and for convenience of manufacture can be deposited directly onto the patterned conducting film.

The gate electrode is comprised of a patterned electrically conductive material which is electrically isolated from the fibrous cathode and the anode containing the phosphor layer. This is most readily accomplished by depositing the patterned electrically conductive material on an electrically insulating material located between the cathode and the phosphor layer. Materials suitable for the gate electrode include any of the metallic conductors commonly used as film conductors such as copper, gold, aluminum, indium-tin oxide, tungsten, molybdenum, chrome and the like. The patterned material can be in the form of rows or strips. These rows or strips can contain holes to allow for the passage of the electrons from the cathode to the anode. In one embodiment, the conductive rows or strips of the gate electrode are positioned substantially orthogonal to the conductive rows of the anode. Individual addressing is also possible such as in a matrix addressing scheme.

A suitable vacuum should be provided in the region between the cathode and the anode/phosphor layer and all materials in contact with or exposed to vacuum used in forming the display panel must be compatible with such a vacuum.

Each conductive row element of the anode can be selectively connected to a voltage source to provide a suitable voltage with respect to the cathode and thereby provide a voltage for field emission or beam steering. These voltages will typically be from about 200 V to about 20 kV depending on the particular design of the display panel. Each conductive row or strip of the gate electrode can be selectively connected to a voltage source to provide a suitable voltage with respect to the cathode and thereby provide a control voltage for field emission or beam steering. These voltages will typically be from about 10 V to about 200 V depending on the particular design of the display panel. Control of electron emission is obtained from a combination of the voltages applied to the anode rows and the gate electrode rows or strips so that the fibrous cathode can be selectively controlled to provide addressable control of pixels in the phosphor layer. Light from these pixels propagates through the optically transparent electrically conductive film of the anode and through the optically transparent anode support plate to provide the image seen by the observer. The necessary voltages can readily be applied to the electrically conducting anode and gate electrode and to the fibrous cathode if the core fibers are electrically conducting or to an electrical conductor which is in contact with the composite fibers.

Figure 4:
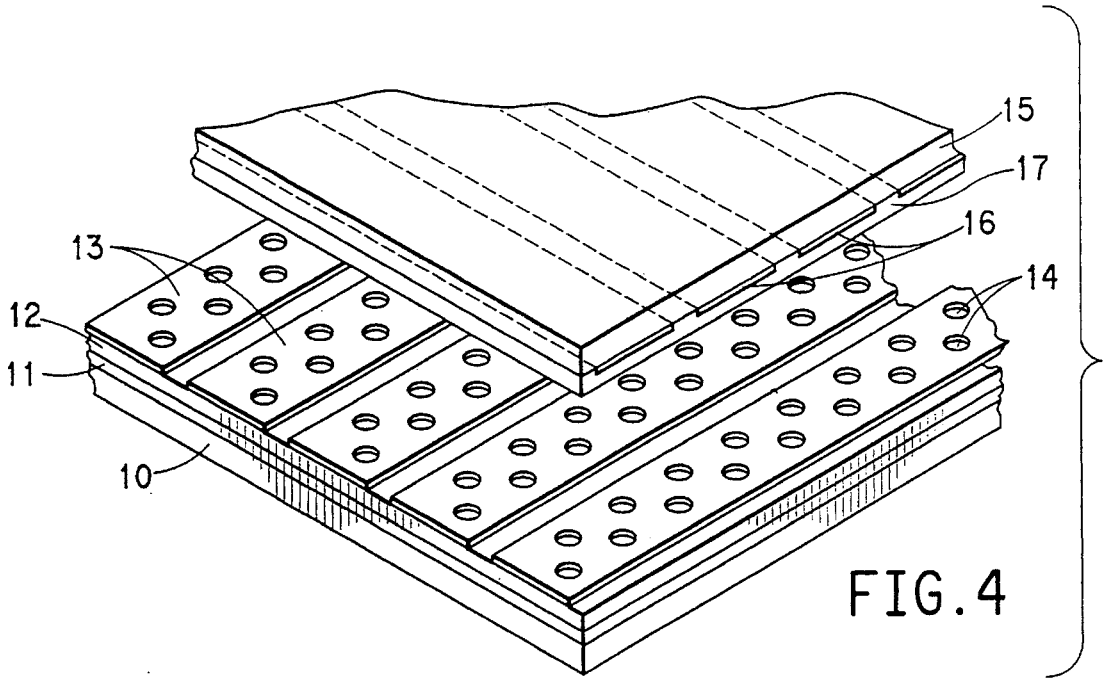
FIG. 4 shows a flat panel display using the electron emitting composite fibers of this invention.

An embodiment of such a display panel (e.g., flat panel display) is shown in FIG. 4. Diamond, diamond-like carbon or glassy carbon composite fibers at least about 1 μm in diameter are randomly placed over the entire surface of substrate 10 to form the fibrous cathode 11. A layer of an electrically insulating material 12 supports the gate electrode 13 which consists of rows of electrically conductive material. Typical insulators that can be used include Kapton® (Kapton® is a registered trademark of E. I. du Pont de Nemours and Company, Wilmington, Del.), ceramics or glasses. Since the gate electrode and its support lie directly in the path of emitted electrons traveling toward the anode 16, holes 14 are formed through the gate electrode and the insulating material to allow for their passage. The insulating material is situated on the fibrous cathode thereby holding the fibers of the fibrous cathode in place. A glass anode support plate 15 contains the anode 16 which consists of rows of optically transparent electrically conductive film orthogonal to the rows of the gate electrode. A layer of phosphor 17 is superimposed on the anode and anode support plate. In this embodiment electrons emitted from the fibrous cathode pass through the holes in the gate electrode and the insulating support and impinge upon the phosphor layer. The holes serve to define the area of the phosphor layer addressed. The holes can be circular as shown in FIG. 4, but other shaped holes can also be used. The gate electrode and the phosphor layer are held apart by mechanical spacers not shown in FIG. 4. The spacers are made of an electrically insulating material and can be in the form of posts situated at appropriate places, recesses in or supports extending from the sides of the container holding the flat panel display or combinations thereof. Alternatively, the spacers can be formed as part of the structure of either the cathode substrate or the anode support plate.

Figure 5A:
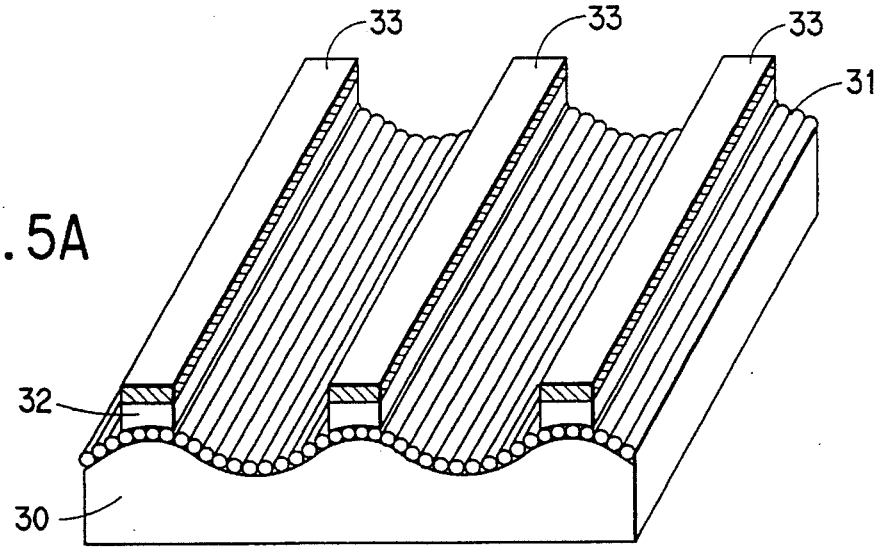
FIGS. 5A and 5B show a fibrous cathode formed on an undulating substrate surface and a gate electrode for a flat panel display.
Figure 5B:
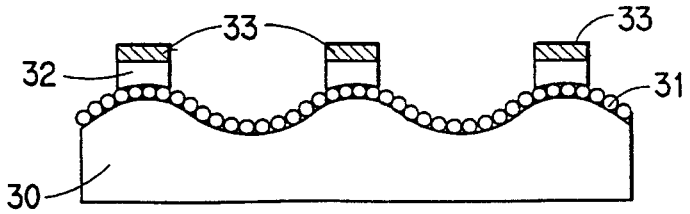

As indicated previously, the fibrous cathode can be shaped to provide improved performance. An embodiment of such a cathode and a gate electrode is shown in FIG. 5. The cathode substrate 30 in this embodiment is made from an electrical conductor. Typical substrate materials include copper, aluminum and nickel. The substrate surface supporting the fibrous cathode 31 is a regularly undulating surface with parallel rows of crests and valleys. "Regularly undulating surface" is used herein to describe an undulating surface in which the distance between the centers of any two adjacent crests or any two adjacent valleys is the same. The width of the crests do not have to be equal to the width of the valleys. The fibrous cathode consists essentially of a uniform array of aligned diamond, diamond-like carbon or glassy carbon composite fibers placed on the undulating surface. The fibers are aligned parallel to the rows of crests and valleys. This results in an undulating fibrous cathode. Strips of electrically insulating layer 32 are deposited onto the undulating fibrous cathode on the crests of the undulations. Insulators such as Kapton®, ceramics or glasses can be used. The gate electrode 33 is deposited onto the strips of insulating material, and consists of an electrically conductive material.

Figure 6A:
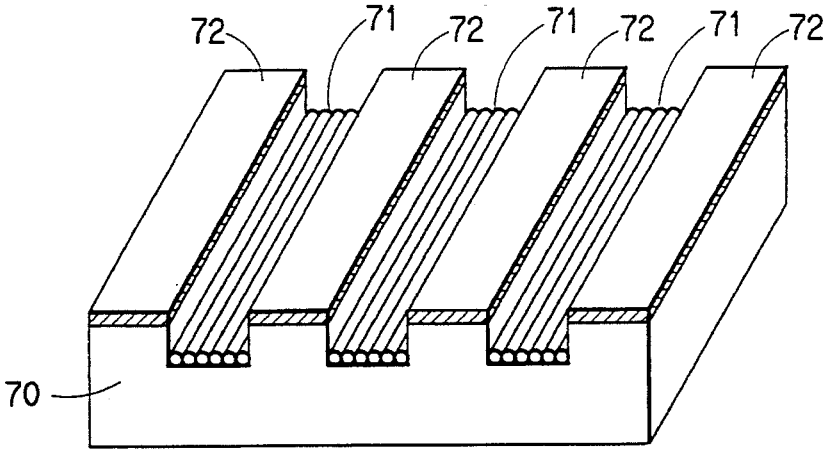
FIGS. 6A and 6B show a fibrous cathode formed on an undulating electrically insulating substrate surface and a gate electrode for a flat panel display.
Figure 6B:
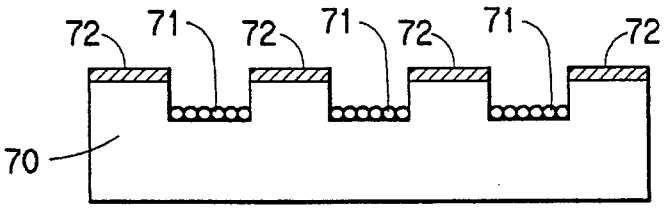

Another embodiment of a cathode formed on a substrate with a undulating surface and a gate electrode is shown in FIG. 6. The cathode substrate 70 is an electrical insulator. Typical substrate materials include ceramics, glasses, polymers such as engineering grade polyesters, nylons, or other dielectric materials. The substrate surface supporting the fibrous cathode is a regularly undulating surface with parallel rows of crests and valleys in which the horizontal crests and valleys are connected by vertical surfaces. The fibrous cathode 71 consists essentially of a uniform array of a single layer of diamond, diamond-like carbon or glassy carbon composite fibers aligned along the length of each valley of the undulating surface. The gate electrode 72 is deposited along the length of each crest of the undulating surface of the insulator. A related embodiment is identical to the one shown in FIG. 6 except that the fibrous cathode consists essentially of one diamond, diamond-like carbon or glassy carbon composite fiber preferably about 1 μm to about 100 μm in diameter aligned along the length of each valley on the undulating surface. Another related embodiment is identical to the one shown in FIG. 6 except that the fibrous cathode consists essentially of a multilayer bundle of diamond, diamond-like carbon or glassy carbon composite fibers with a bundle of such fibers aligned along the length of each valley on the undulating surface.

Figure 7A:
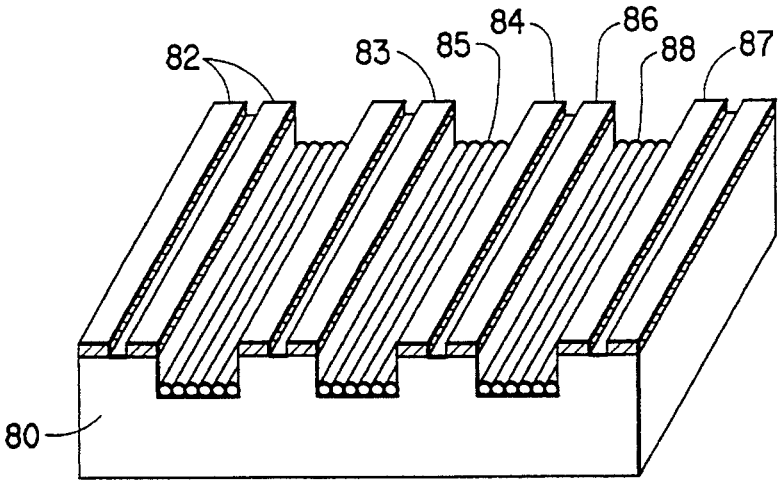
FIGS. 7A and 7B show a fibrous cathode and a split-gate electrode for a flat panel display.
Figure 7B:
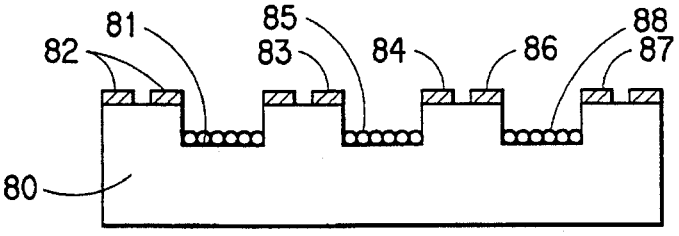

In the embodiment shown in FIG. 6, each row of the gate electrode, i.e., the portion of the gate electrode on a particular crest, influences the emission of the composite fibers in the two adjoining valleys. Better defined emission and more precise addressing of pixels in the phosphor can be achieved if the gate electrode is comprised of two parallel strips on each crest rather than just one. This split-gate electrode embodiment is shown in FIG. 7.

The cathode substrate 80, the substrate surface supporting the fibrous cathode and the fibrous cathode 81 consisting of an array of a single layer of diamond, diamond-like carbon or glassy carbon composite fibers aligned along the length of each valley of the undulating surface are identical to the comparable parts shown in FIG. 6. However, the gate electrode 82 of FIG. 7 is comprised of two parallel strips on each crest of the surface rather than just the single strip of FIG. 6. Gate electrode strips 83 and 84 only control the emission of the composite fibers 85 and similarly gate electrode strips 86 and 87 only control the emission of the composite fibers 88.

Use of an electrically insulating substrate in the various embodiments discussed in connection with FIG. 6 and FIG. 7 allows the deposition of the gate electrodes directly on the crests of the substrate. If an electrically conducting substrate is used, strips of insulating material must be deposited on the crests before the gate electrode is formed.

When the substrate with the undulating surface is electrically insulating and the fibrous cathode comprises diamond, diamond-like carbon or glassy carbon composite fibers aligned along the length of each valley of the undulating surface, whether they be a single layer of fibers, a bundle of fibers, a single fiber (between about 1 to 100 μm) or some other configuration of fibers, an electrically conducting film can, although it may not be preferred, be deposited along the length of each valley before placing the composite fibers in the valleys. Metals such as copper, gold, chromium, molybdenum, and tungsten can be used. Such films may provide electron reservoirs for the electron emitting composite fibers and also enable the emitting composite fibers in each valley to be addressed individually if desired.

In all of the embodiments in which the fibrous cathode is formed on a undulating surface of a substrate, the surface can be smoothly undulating as shown in FIG. 5 or the transition from crest to valley can be more abrupt so that the profile of the undulating surface resembles a "square wave" as shown in FIG. 6 and FIG. 7. In addition, the surface can be smooth (e.g., flat) or the fibrous cathode can be suspended above the surface of the substrate on stand-offs or pedestals.

A useful method in manufacturing cathodes on a substrate with an undulating surface is to provide a comb-like structure at each end of the cathode substrate with the teeth of the comb-like structures coincident with the regions of the crests of the undulating surface and the spaces between the teeth of the comb-like structures coincident with the regions of the valleys of the undulating surface. Fibers, bundles of fibers and individual larger fibers can be readily placed along the valleys of the surface by locating them between corresponding teeth of the comb-like structures.

When the fibrous cathode is comprised of distinct elements as is the case when the cathode is comprised of composite fibers only in the valleys of an undulating surface of the substrate, a single element of the cathode can be addressed by a voltage applied between a single element of the cathode, e.g., the emitting composite in one valley, and a row of the anode and in this manner electron emission from the fibrous cathode can be selectively controlled to provide addressable control of pixels in the phosphor layer without the need for a gate electrode. This provides a simpler configuration and ease of manufacture, but the use of a gate electrode is preferred to provide better performance.

In another embodiment, the display panel further comprises a screen electrode located between the gate electrode and the phosphor layer. A voltage applied to this screen electrode allows the use of lower emission control voltages on the gate electrode and provides higher acceleration voltages. Other higher order or multiple gate electrode schemes are also applicable (e.g., pentode).

The present invention is more particularly described in the following non-limiting examples which are intended as illustrative only.

EXAMPLE 1

Graphite fibers, prepared from polyacrylonitrile, having a thickness within the range of about 3 microns to about 15 microns were pre-cleaned and abraded in a methanol suspension of diamond paste with diamond particle sizes in the range of about 0.25 microns to about 1.0 micron. The suspension of fibers was ultrasonically vibrated for between 5 and 60 minutes to cause abrasion of the fiber surface to occur. The fibers were removed from the suspension, blotted to remove much of the solvent and inserted into a deposition chamber for the microwave-assisted plasma CVD of diamond.

Diamond film coatings were deposited by a standard microwave plasma deposition technique. Deposition parameters were maintained within the following ranges: Process Gas—from about 0.3 to 5.0 percent by volume methane in hydrogen, preferably about 0.6 percent by volume methane in hydrogen; Pressure—from about 10 to 75 Torr, preferably about 40 Torr; Substrate temperature—from about 470° to 1000° C., preferably about 900° C.; and, Microwave power—from about 700 to 1500 Watts, preferably about 1500 Watts.

Secondary electron micrographs taken after diamond deposition showed successful deposition of diamond on the graphite. The diamond film coatings were from about 4 to 15 microns in thickness on the graphite fibers originally about 5 to 10 microns in thickness. Raman spectroscopy confirmed that the deposited film coating comprising diamond.

Figure 2:
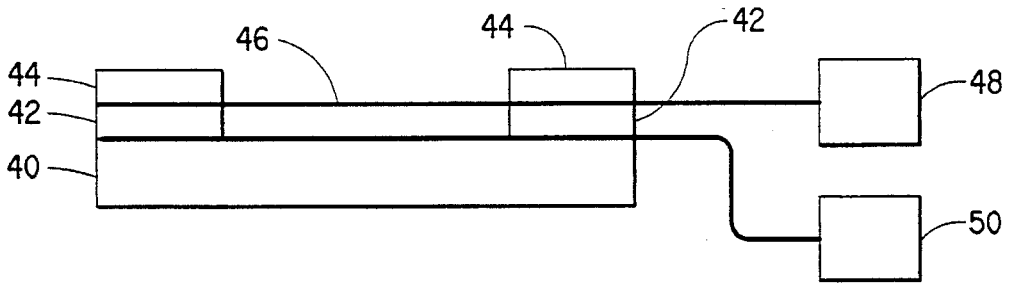
FIG. 2 shows a test assembly employed for measuring emission current on emitter samples.

A field emission set-up to measure emission current was fabricated as shown in FIG. 2. The set-up included a gold coated alumina collector pad 40 as the anode, glass coverslip spacers 42, glass coverslips 44 coated on one side with gold for electrical contact with the graphite-diamond composite fibers 46 as the cathode (a bundle of about 40 to 50 filaments), a 3 kV power supply 48 (a commercially available Keithley 247 High Voltage Supply) connected to the fibers 46, and an electrometer 50 (a commercially available Keithley 617 Electrometer) connected to the collector pad 40. The spacing between the fibers 46 and the collector pad 40 was about 20 to 40 microns. This entire setup was placed into a vacuum chamber which was pumped down to a base pressure of $2\times10^{-7}$ Torr prior to commencing field emission measurements. Typically, the emission current dropped with time for a few minutes and then reached a steady state after which no further decrease in the emission current was observed even after several hours of emission. The measured emission current was this steady state current. Emission current measurements were made at a number of voltages and plotted as Fowler-Nordheim-like plots as shown in FIG. 1. In FIG. 1, plots 20, 22, 24, and 26 are taken from Kumar et al. (FIG. 10 at p. 1010), SID 93 Digest, pp. 1009–1011, 1993. Plot 28 is with the diamond-graphite composite field emitter of the present example and shows low voltage switch-on requirements as indicated by the x-coordinate and shows excellent current densities as indicated by the y-coordinate.

EXAMPLE 2

Graphite fibers as in Example 1 were coated with diamond using hot filament CVD. The resultant diamond-coated graphite fiber yielded emission current measurements shown as plot 29 in FIG. 1.

EXAMPLE 3

The technique of laser evaporation has been applied to a large class of materials ranging from polymers to semiconductors and dielectrics. It has been applied extensively to form thin films of inorganic materials, such as ceramic oxides exhibiting superconductivity to fill the demand of the electronic industry for device applications. A method for producing stoichiometric thin films of oxides, nitrides, polymers and carbides by irradiating a target by a laser and depositing the gaseous products so formed onto a substrate to fabricate a thin film wherein the plasma is generated synchronously with the laser irradiation has also been disclosed.

Consistent with the above, this example describes a process for producing diamond-like carbon emitting fibers on nickel coated Kevlar® fibers by ultraviolet laser ablation. The Kevlar® fibers are non-conductive.

Commercially available Kevlar®-29 fibers, having a thickness of about 10 microns were obtained from E. I. du Pont de Nemours and Company's facility in Richmond, Va. These Kevlar® fibers, manufactured in bundles of 2000 fibers, were spread onto a microscope slide by slightly charging them. After the spread end of the bundle was anchored, it was then cut to 2 inches in length, and the other end was spread and anchored prior to the nickel evaporation. The spread Kevlar® fibers were then placed in a standard RF magnetron unit from Denton Vacuum of Cherry Hill, N.J. for sputtering. The thickness of the metal on the fibers was measured with a quartz crystal during the sputtering. After deposition was completed the fibers were turned over such that the facet previously positioned towards the glass faced up while the areas already sputtered with Ni were positioned towards the glass. The sputtering was then repeated. The argon pressure during the nickel sputtering was maintained to 75 mtorr. and the thickness of metal on the surface of the fibers was 500 Å.

The nickel coated Kevlar® fibers were then positioned in a vacuum chamber where a DLC overcoat was applied by ablating a graphite target. The graphite target was positioned at the center of the vacuum chamber about 4 cm from the Ni coated Kevlar fibers. The spread fibers were mounted on a rotary sample holder that, with a rack and pinion mechanism, allowed the fibers to be rotated during the deposition assuring a uniform coating across the fiber surface. The thin DLC film was deposited by ablating a graphite target using the fourth harmonic line at 266 nm of a Spectra Physics GCR170 pulsed Nd-YAG laser with 10 nanosecond pulses at 2 Hz repetition rate. The laser fluence during deposition was 6 $J/cm^2$ and the background pressure was maintained at $1\times10^{-6}$ torr. The 1 $cm^2$ near gaussian beam was directed into the chamber by a pair of plane mirrors and focused onto a 2.5×2 mm spot onto the surface of a solid graphite pellet located at the center of the vacuum chamber, by a 300 mm quartz lens positioned at the entrance of the vacuum chamber. Uniform coverage of the substrate was assured by rastering the laser beam onto a 1×1 cm square over the target with a set of motorized micrometers placed on the last plane mirror. The graphite targets were obtained by slicing commercially available rods (pyrolitic graphite, 12" in length ×1.5" in diameter rods at 99.99% purity available from Alfa-Aesar of Ward-Hill, Mass.).

Figure 8:
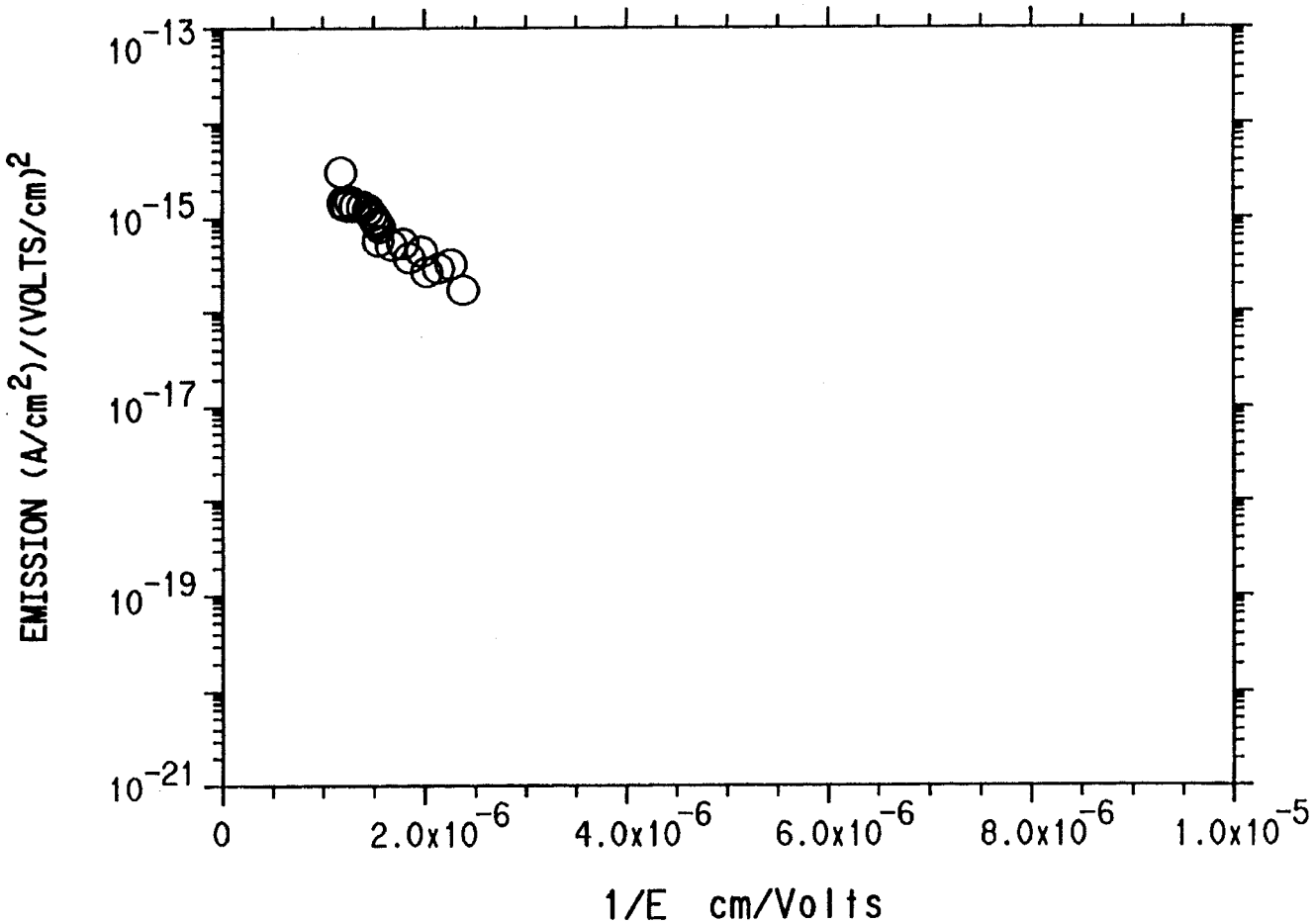
FIG. 8 shows emission current measurements made at a number of voltages presented as a Fowler-Nordheim plot.

Emission current measurements were made at a number of voltages and plotted as a Fowler-Nordheim plot as shown in FIG. 8.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than the foregoing specification, as indicating the scope of the invention.

What is claimed is:

1. A field emission electron emitter comprising an electrode fabricated from at least one diamond composite fiber, said diamond composite fiber comprising a non-diamond core and a diamond coating on said non-diamond core, wherein electron emission occurs along the length of the fiber.

2. The field emission electron emitter of claim 1 wherein said non-diamond core comprises a conductive or semiconductive material.

3. The field emission electron emitter of claim 1 wherein said non-diamond core comprises a non-conductive material surrounded by a film coating of a conductive or semiconductive material.

4. The field emission electron emitter of claim 1 wherein said diamond composite fiber comprises a graphite core and a diamond coating upon said graphite core.

5. The field emission electron emitter of claim 4 wherein said diamond composite fiber has a diameter of less than about 100 microns and a diamond layer of less than about 5 microns.

6. The field emission electron emitter of claim 5 wherein said diamond coating comprises polycrystalline diamond having a major portion of crystal sizes of less than about 1 micron in at least one dimension.

7. The field emission electron emitter of claim 6 wherein said diamond coating contains minor amounts of graphite between at least a portion of said diamond crystals within said diamond coating.

8. The field emission electron emitter of claim 1 wherein said diamond coating comprises polycrystalline diamond having a major portion of crystal sizes of less than about 1 micron in at least one dimension.

9. The field emission electron emitter of claim 8 wherein said diamond coating contains minor amounts of graphite between at least a portion of said diamond crystals within said diamond coating.

10. A field emission electron emitter comprising an electrode fabricated from at least one diamond-like carbon composite fiber, said diamond-like carbon composite fiber comprising a non-diamond core, wherein electron emission occurs along the length of the fiber.

11. The field emission electron emitter of claim 10 wherein said non-diamond core comprises of a conductive or semi-conductive material.

12. The field emission electron emitter of claim 10 wherein said non-diamond core comprises a non-conductive material surrounded by a film coating of a conductive or semi-conductive material.

13. The field emission electron emitter of claim 10 wherein said diamond-like carbon composite fiber comprises a graphite core and a diamond-like carbon coating upon said graphite core.

14. The field emission electron emitter of claim 13 wherein said diamond-like carbon fiber has a diameter of less than about 100 microns and a diamond-like carbon layer of less than about 5 microns.

15. The field emission electron emitter of claim 10 wherein said diamond-like carbon coating comprises an ordered arrangement of atoms less than about 10 nanometers in any direction.

16. A field emission electron emitter for use in an electronic device comprising a fibrous integral electrode having a surface area of greater than about one square foot, said fibrous electrode formed of at least one diamond composite fiber comprising a non-diamond core and a diamond coating on said non-diamond core, wherein electron emission occurs along the length of the fiber.

17. The field emission electron emitter of claim 16 wherein said diamond composite fiber comprises a graphite core and a diamond coating upon said graphite core.

18. In an electronic device employing a field emission electron emitter, said emitter comprising a cathode and an anode, the improvement comprising the cathode comprising at least one diamond composite fiber comprising a non-diamond core and diamond coating on said non-diamond core, wherein electron emission occurs along the length of the fiber.

19. In an electronic device according to claim 18 wherein the non-diamond core comprises a conductive or semi-conductive material.

20. In an electronic device according to claim 18 wherein the non-diamond core comprises a non-conductive material surrounded by a film coating of conductive or semi-conductive material.

21. The electronic device of claim 18 wherein said diamond composite fiber comprises a graphite core and a diamond coating upon said graphite core.

22. A display panel comprising:

a fibrous cathode formed of at least one diamond, diamond-like carbon or glassy carbon composite fiber comprising a non-diamond core and a diamond, diamond-like carbon or glassy carbon coating on said non-diamond core;

an anode spaced apart from said fibrous cathode, said anode comprising a layer of patterned optically transparent conductive film upon a cathode-facing surface of an anode support plate;

a layer of a phosphor material capable of emitting light upon bombardment by electrons emitted from the composite fiber of the cathode, the phosphor layer positioned adjacent the layer of patterned optically transparent conductive film;

a gate electrode comprising a patterned structure of conductive paths arranged substantially orthogonally to the patterned optically transparent conductive film, each conductive path selectively operably connected to an electron source; and a voltage source connected between said anode and said fibrous cathode and wherein electron emission occurs along the length of the fiber.

23. The display panel of claim 22 wherein said composite fiber has a diameter of less than about 100 microns and a diamond, diamond-like carbon or glassy carbon layer of less than about 5 microns.

24. The display panel of claim 22 wherein said composite fiber comprises a graphite core and a diamond, diamond-like carbon or glassy carbon coating upon said graphite core.

25. The display panel of claim 24 wherein said diamond coating comprises polycrystalline diamond having a major portion of crystal sizes of less than about 1 micron in at least one dimension.

26. The display panel of claim 25 wherein said diamond coating comprises minor amounts of graphite between at least a portion of said diamond crystals within said diamond coating.

27. A display panel comprising:

(a) a fibrous cathode formed of at least one diamond, diamond-like carbon or glassy carbon composite fiber consisting essentially of diamond, diamond-like carbon or glassy carbon coating on a non-diamond core;

(b) a patterned optically transparent electrically conductive film serving as an anode and spaced apart from the fibrous cathode;

(c) a phosphor layer capable of emitting light upon bombardment by electrons emitted by the composite fiber and positioned adjacent to the anode; and (d) a gate electrode disposed between the phosphor layer and the fibrous cathode, and wherein electron emission occurs along the length of the fiber.

28. The display panel of claim 27 wherein said fibrous cathode is comprised of an array of composite fibers, each of which is at least 1 μm in diameter.

29. The display panel as in claim 27 or claim 28, in which holes are provided in said gate electrode and any structure supporting said gate electrode to allow passage of electrons emitted from said fibrous cathode to said phosphor layer.

30. The display panel of claim 27 wherein said fibrous cathode is comprised of a uniform aligned parallel array of said composite fibers, each of which is at least 1 μm in diameter.

31. The display panel of claim 30 wherein said fibrous cathode is supported by a regularly undulating surface of an electrically conducting substrate and said composite fibers are aligned parallel to the rows of crests and valleys of said undulating surface thereby forming an undulating fibrous cathode; strips of an electrically insulating layer are deposited onto the crests of the undulations of said undulating fibrous cathode; and said gate electrode is deposited onto the strips of said insulating layer.

32. The display panel of claim 27 wherein the support of said fibrous cathode is an electrical insulator and has a regularly undulating surface with parallel rows of crests and valleys; said fibrous cathode consists essentially of composite fibers aligned along the length of each valley of said undulating surface; and said gate electrode is comprised of a strip of electrically conducting material deposited along the length of each crest of said undulating surface of said insulator.

33. The display panel of claim 32 wherein a uniform array of a single layer of composite fibers is aligned along the length of each valley of said undulating surface.

34. The display panel of claim 32 wherein one composite fiber about 1 μm to about 100 μm in diameter is aligned along the length of each valley of said undulating surface.

35. The display panel of claim 32 wherein a multilayer bundle of composite fibers is aligned along the length of each valley on the undulating surface.

36. The display panel as in any of claims 32–35, in which said undulating surface has horizontal crests and valleys connected by vertical surfaces.

37. The display panel of claim 27 wherein the support of said fibrous cathode comprises an electrical insulator and has a regularly undulating surface with parallel rows of crests and valleys; said fibrous cathode consists essentially of composite fibers aligned along the length of each valley of said undulating surface; and said gate electrode is comprised of two strips of electrically conducting material deposited along the length of each crest of said undulating surface of said insulator.

38. The display panel of claim 37 wherein a uniform array of a single layer of composite fibers is aligned along the length of each valley of said undulating surface.

39. The display panel of claim 37 wherein one composite fiber about 1 μm to about 100 μm in diameter is aligned along the length of each valley of said undulating surface.

40. The display panel of claim 37 wherein a multilayer bundle of composite fibers is aligned along the length of each valley on the undulating surface.

41. The display panel as in any of claims 37–40, in which said undulating surface has horizontal crests and valleys connected by vertical surfaces.

42. The display panel of claim 27 further comprising at least one additional electrode located between the gate electrode and the phosphor layer.

43. A display panel comprising:

(a) a fibrous cathode formed of at least one diamond, diamond-like carbon or glassy carbon composite fiber comprising diamond, diamond-like carbon or glassy carbon on at least one non-diamond core fiber;

(b) a patterned optically transparent electrically conductive film serving as an anode and spaced apart from the fibrous cathode; and (c) a phosphor layer capable of emitting light upon bombardment by electrons emitted by the composite fiber and positioned adjacent to the anode, and wherein electron emission occurs along the length of the fiber.

44. The display of claim 43 wherein said non-diamond core fiber is comprised of a conductive or semi-conductive material.

45. The display panel as in any of claims 27, 42 or 43, in which said fibrous cathode is suspended above the surface of a substrate on stand-offs or pedestals.

46. The display panel of claim 43 wherein said non-diamond core fiber is comprised of a non-conductive material surrounded by a film coating of conductive or semi-conductive material.

47. A field emission electron emitter comprising an electrode fabricated from at least one glassy carbon composite fiber, said glassy carbon composite fiber comprising a non-diamond core and glassy carbon coating on said non-diamond core, wherein electron emission occurs along the length of the fiber.

48. The field emission electron emitter of claim 47 wherein said non-diamond core comprises of a conductive or semi-conductive material.

49. The field emission electron emitter of claim 47 wherein said non-diamond core comprises a non-conductive material surrounded by a film coating of a conductive or semi-conductive material.

50. The field emission electron emitter of claim 47 wherein said glassy carbon composite fiber comprises a graphite core and a glassy carbon coating upon said graphite core.

51. The field emission electron emitter of claim 50 wherein said glassy carbon fiber has a diameter of less than about 100 microns and a glassy carbon layer of less than about 5 microns.

52. The field emission electron emitter of claim 47 wherein said glassy carbon coating comprises an ordered arrangement of atoms less than about 10 nanometers in any direction.

53. In an electronic device employing a field emission electron emitter, said emitter comprising a cathode and an anode, the improvement comprising the cathode comprising at least one glassy carbon composite fiber comprising a non-diamond core and a glass carbon coating on said non-diamond core, wherein electron emission occurs along the length of the fiber.

54. In an electronic device according to claim 53 wherein the non-diamond core comprises a conductive or semi-conductive material.

55. In an electronic device according to claim 53 wherein the non-diamond core comprises a non-conductive material surrounded by a film coating of conductive or semi-conductive material.

56. The electronic device of claim 53 wherein said glassy carbon composite fiber comprises a graphite core and a glassy carbon coating upon said graphite core.

57. The display panel as in any of claims 22, 27 or 43 wherein the phosphor layer is positioned between the anode and the cathode.

58. The display panel as in any of claims 22, 27 or 43 wherein the anode is positioned between the phosphor layer and the cathode.

* * * * *